US011720043B2

(12) United States Patent
Chonabayashi

(10) Patent No.: US 11,720,043 B2
(45) Date of Patent: Aug. 8, 2023

(54) RECORDING MATERIAL TRANSPORT DEVICE AND IMAGE FORMING APPARATUS

(71) Applicant: FUJIFILM Business Innovation Corp., Tokyo (JP)

(72) Inventor: Yuya Chonabayashi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 357 days.

(21) Appl. No.: 16/868,543

(22) Filed: May 7, 2020

(65) Prior Publication Data

US 2021/0141330 A1 May 13, 2021

(30) Foreign Application Priority Data

Nov. 7, 2019 (JP) ..... 2019-202612

(51) Int. Cl.

| | |
|---|---|
| ***B65H 1/26*** | (2006.01) |
| ***B65H 5/06*** | (2006.01) |
| ***B65H 5/38*** | (2006.01) |
| ***G03G 15/00*** | (2006.01) |

(52) U.S. Cl.

CPC ..... *G03G 15/6529* (2013.01); *B65H 5/068* (2013.01); *B65H 5/38* (2013.01); *B65H 2402/32* (2013.01); *B65H 2601/321* (2013.01)

(58) Field of Classification Search

CPC ..... B65H 2601/321; B65H 2601/11; B65H 5/062; B65H 5/068; B65H 2405/12; B65H 5/36; B65H 5/38; B65H 2402/32; B65H 1/266; G03G 15/6529; G03G 21/1638; G03G 21/1623

See application file for complete search history.

(56) References Cited

U.S. PATENT DOCUMENTS

| | | | | |
|---|---|---|---|---|
| 8,960,664 | B2 * | 2/2015 | Maeda | B65H 1/00 399/110 |
| 9,056,745 | B2 * | 6/2015 | Harada | B65H 5/062 |
| 9,944,478 | B2 * | 4/2018 | Kasaishi | B65H 5/36 |
| 10,322,896 | B2 * | 6/2019 | Furuta | B65H 5/36 |
| 2016/0185138 | A1 * | 6/2016 | Takeuchi | G03G 15/6514 271/9.09 |

FOREIGN PATENT DOCUMENTS

| | | |
|---|---|---|
| JP | 2015086039 | 5/2015 |

* cited by examiner

*Primary Examiner* — Luis A Gonzalez
(74) *Attorney, Agent, or Firm* — JCIPRNET

(57) ABSTRACT

A recording material transport device including a transport section that transports a recording material and a support member disposed to extend in a direction intersecting with a vertical direction, and supporting the recording material from below with the transport stopped, in which the support member is provided to be capable of descending, and, as the support member descends, both of one end portion and the other end portion in the direction intersecting with the vertical direction descend and are inclined such that the one end portion is positioned below the other end portion.

16 Claims, 8 Drawing Sheets

RECORDING MATERIAL TRANSPORT DEVICE AND IMAGE FORMING APPARATUS

CROSS-REFERENCE TO RELATED APPLICATIONS

This application is based on and claims priority under 35 USC 119 from Japanese Patent Application No. 2019-202612 filed Nov. 7, 2019.

BACKGROUND

(i) Technical Field

The present invention relates to a recording material transport device and an image forming apparatus.

(ii) Related Art

JP2015-086039A discloses a configuration in which a first transport guide to which a separation pad is attached is fixed to a device main body and a second transport guide is provided to be movable between a transport position and a retreat position.

SUMMARY

A device transporting a recording material may be provided with a support member that supports the recording material from below with the transport stopped. In addition, the support member may descend in a state where the stopped recording material is placed on the support member provided to be capable of descending.

Aspects of non-limiting embodiments of the present disclosure relate to a recording material transport device and an image forming apparatus that make it easier to remove a recording material stopped in a device than in a case where a support member supporting the recording material from below descends while maintaining a horizontal state.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a recording material transport device including a transport section that transports a recording material and a support member disposed to extend in a direction intersecting with a vertical direction, and supporting the recording material from below with the transport stopped, in which the support member is provided to be capable of descending, and, as the support member descends, both of one end portion and the other end portion in the direction intersecting with the vertical direction descend and are inclined such that the one end portion is positioned below the other end portion.

BRIEF DESCRIPTION OF THE DRAWINGS

Exemplary embodiment(s) of the present invention will be described in detail based on the following figures, wherein:

FIG. 3 is an enlarged view of a guide member and so on;

Figure 4:
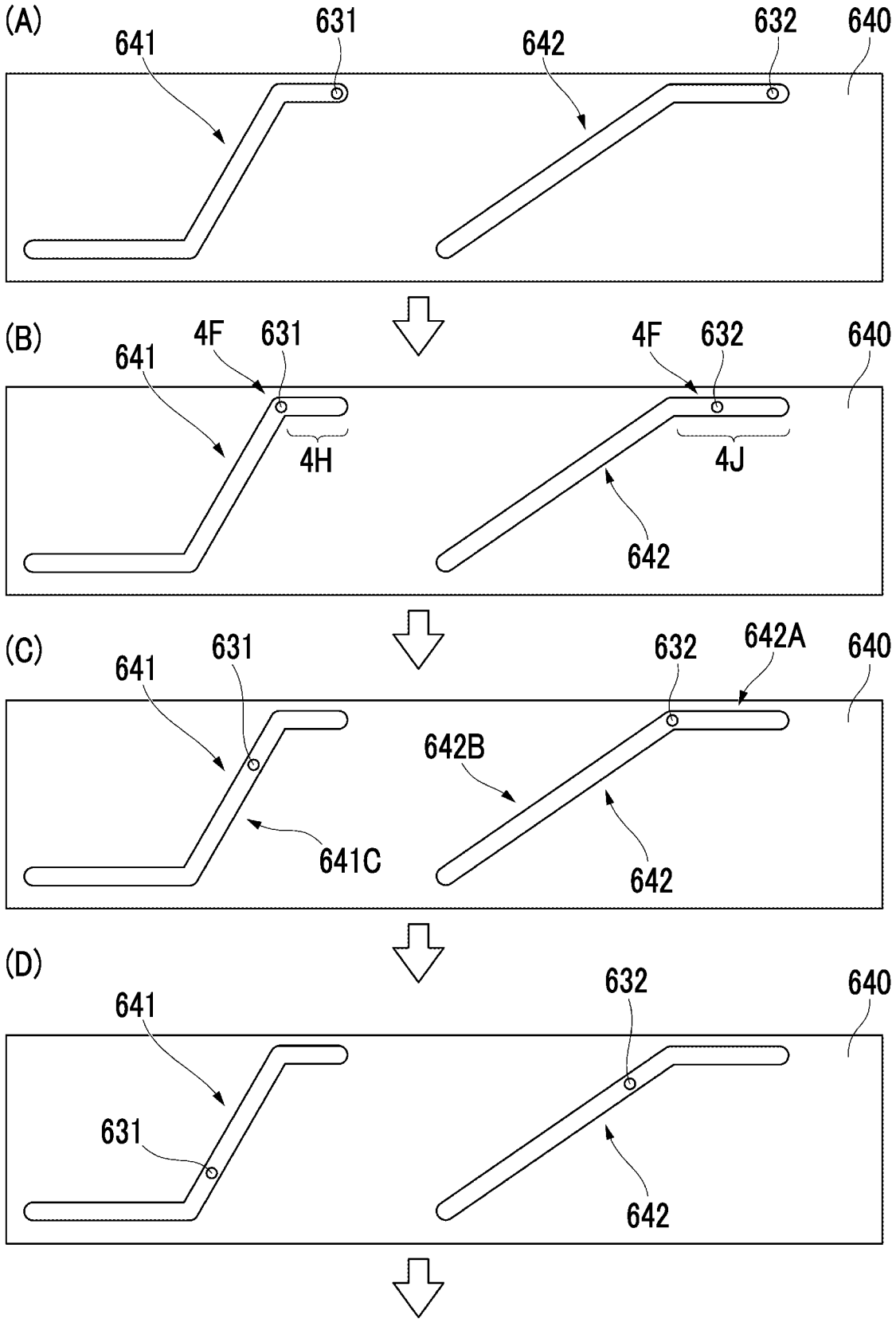
Figure 5:
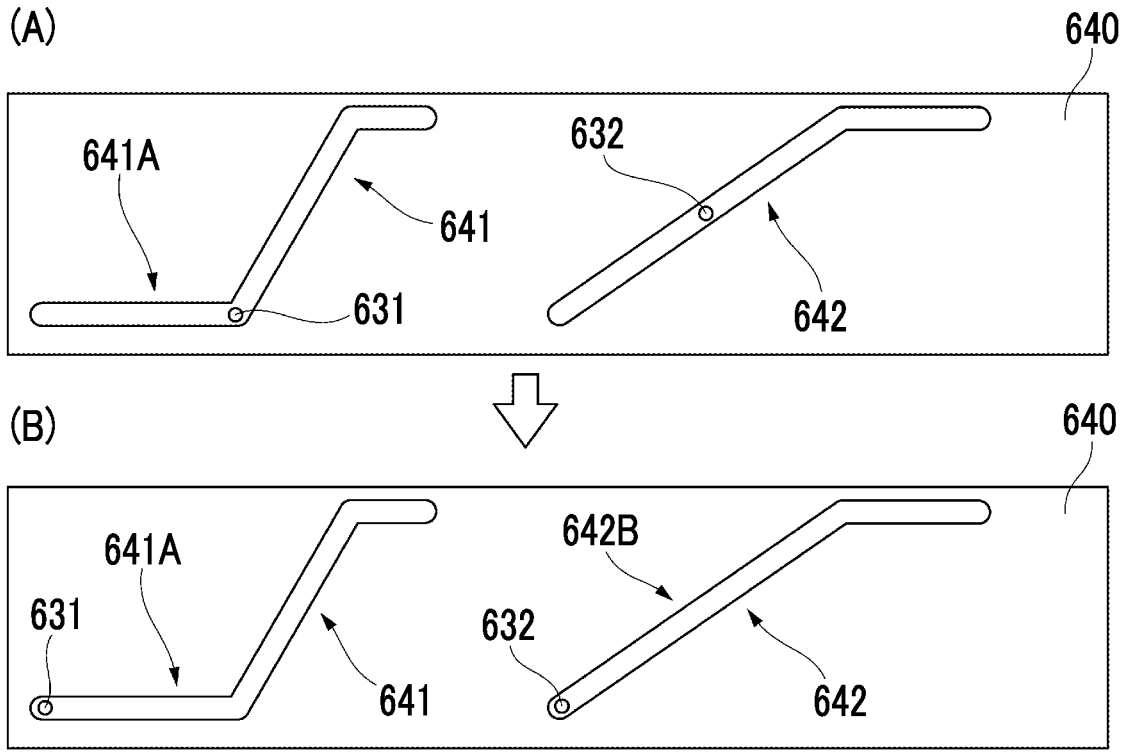
Figure 6:
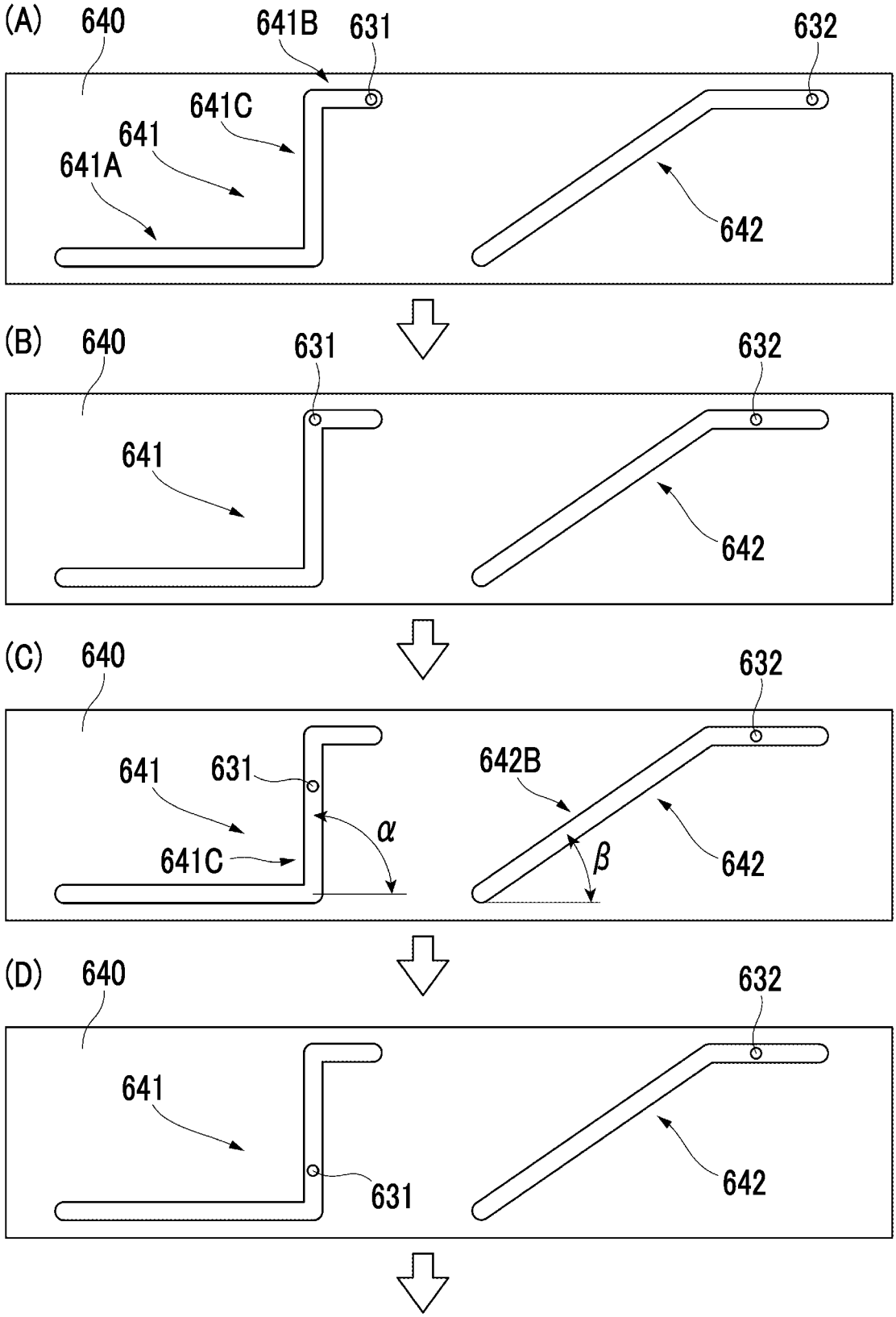
Figure 7:
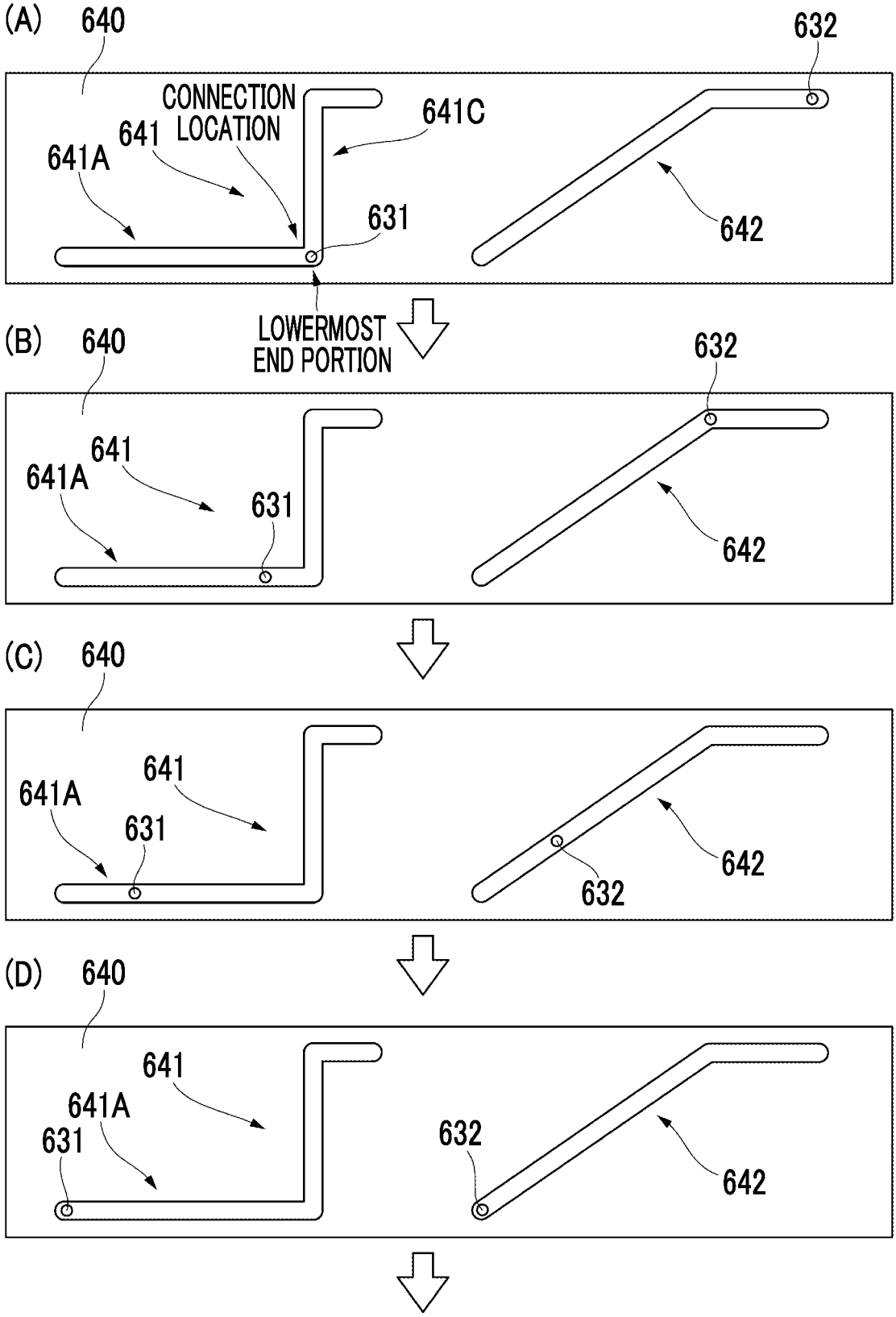
Figure 8:
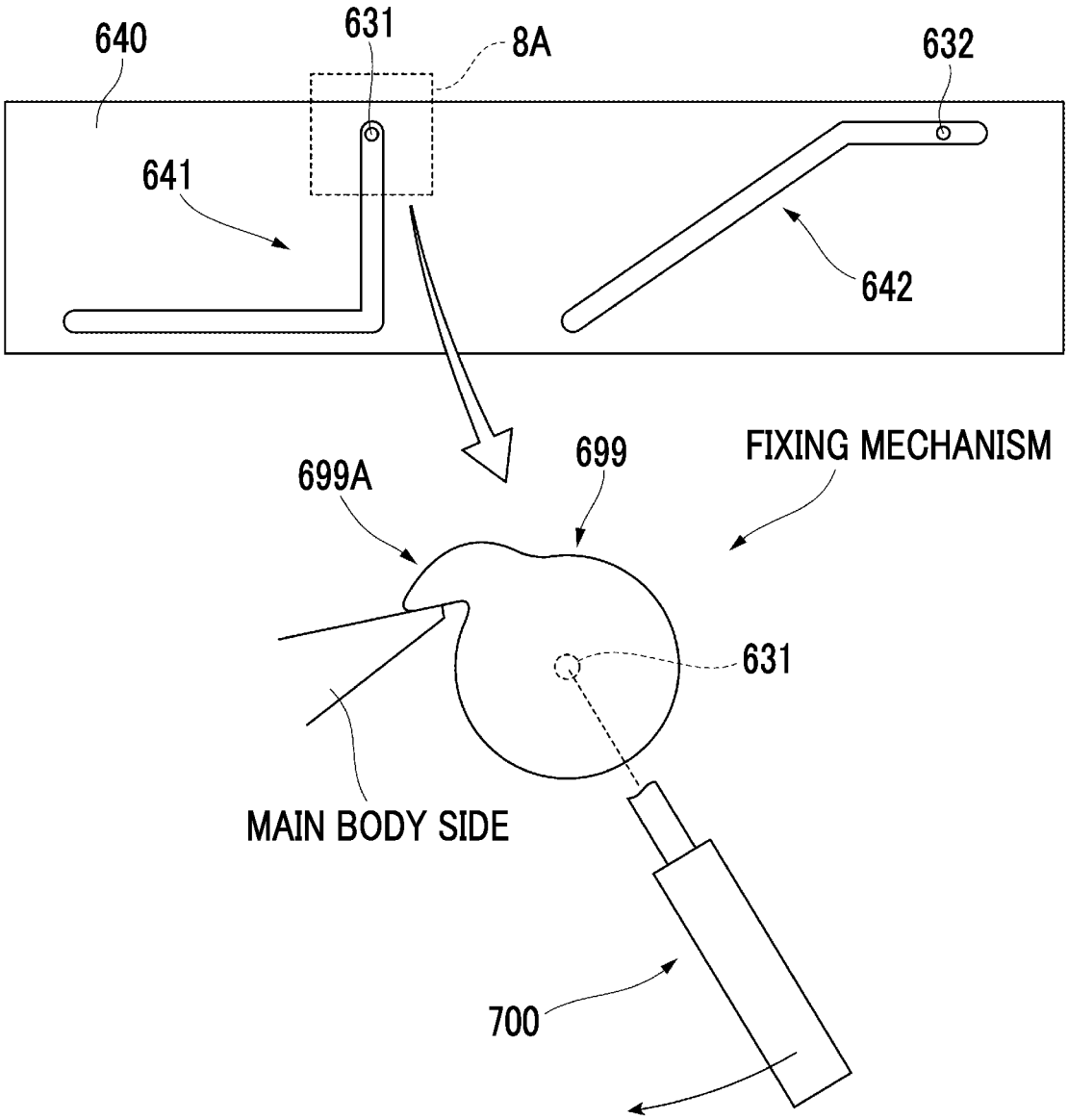

Parts (A) to (D) in FIG. 4 are diagrams illustrating movements of a first projection and a second projection;

Parts (A) and (B) in FIG. 5 are diagrams illustrating the movements of the first projection and the second projection;

Parts (A) to (D) in FIG. 6 are diagrams illustrating another configuration example of the guide member;

Parts (A) to (D) in FIG. 7 are diagrams illustrating another configuration example of the guide member; and FIG. 8 is a diagram illustrating another configuration example of the guide member and so on.

DETAILED DESCRIPTION

Hereinafter, an exemplary embodiment of the present invention will be described with reference to the accompanying drawings.

Figure 1:
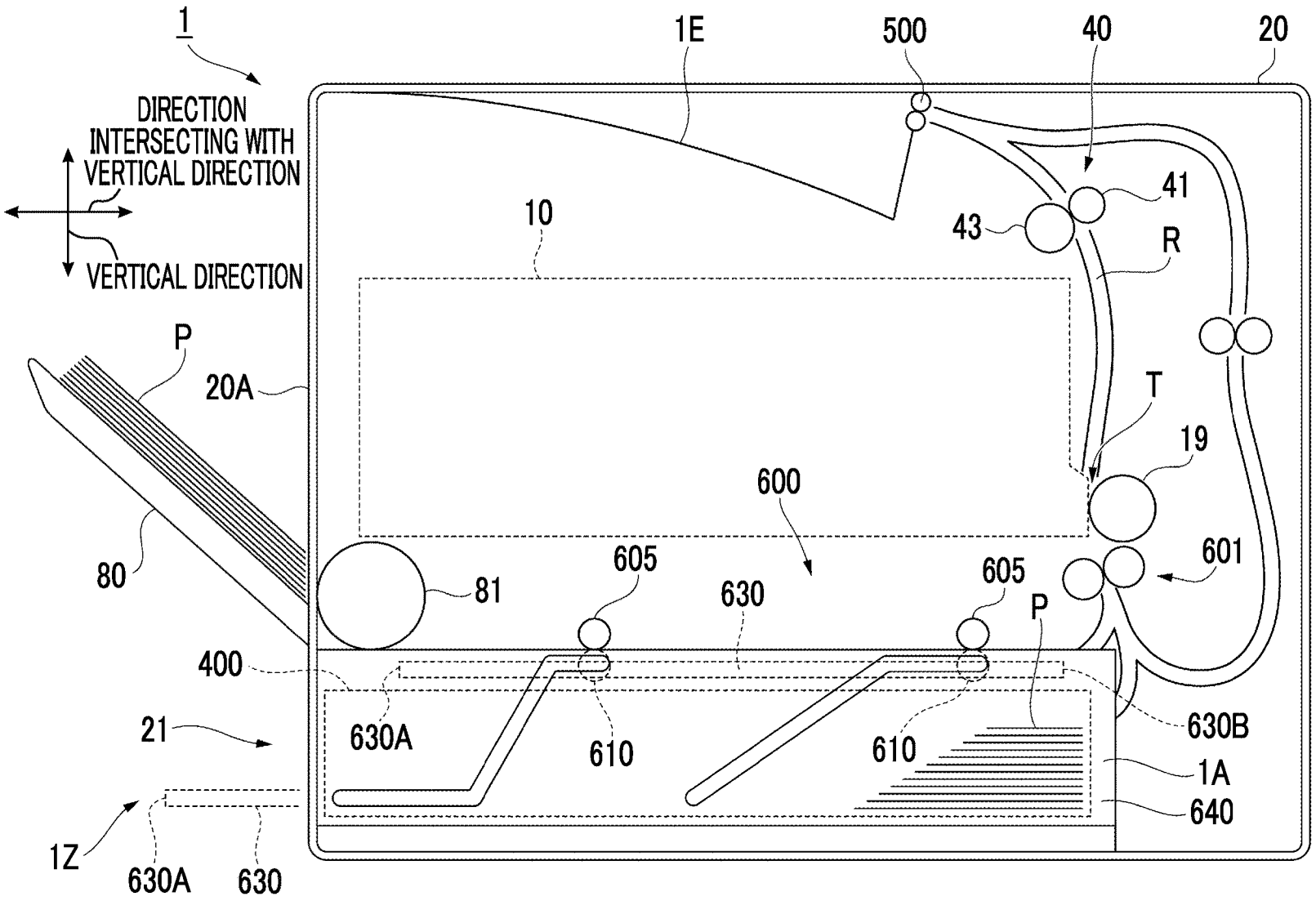
FIG. 1 is an overall configuration diagram in which an image forming apparatus is viewed from the front side of the image forming apparatus.

FIG. 1 is an overall configuration diagram in which an image forming apparatus 1 is viewed from the front side of the image forming apparatus 1.

The image forming apparatus 1 is a so-called tandem-type color printer and includes an image forming unit 10 as an example of an image forming section. The image forming unit 10 performs image formation on a sheet P, which is an example of a recording material, based on image data.

The image forming apparatus 1 is provided with a housing 20 accommodating various functional units. An opening 21 is provided in a side portion 20A and the lower portion of the housing 20.

Here, the housing 20 is not limited to a housing configured by one component and a plurality of components may constitute the housing 20. In addition, the housing 20 is not limited to a rectangular parallelepiped or a cube and may have a shape other than a rectangular parallelepiped or a cube.

Figure 2:
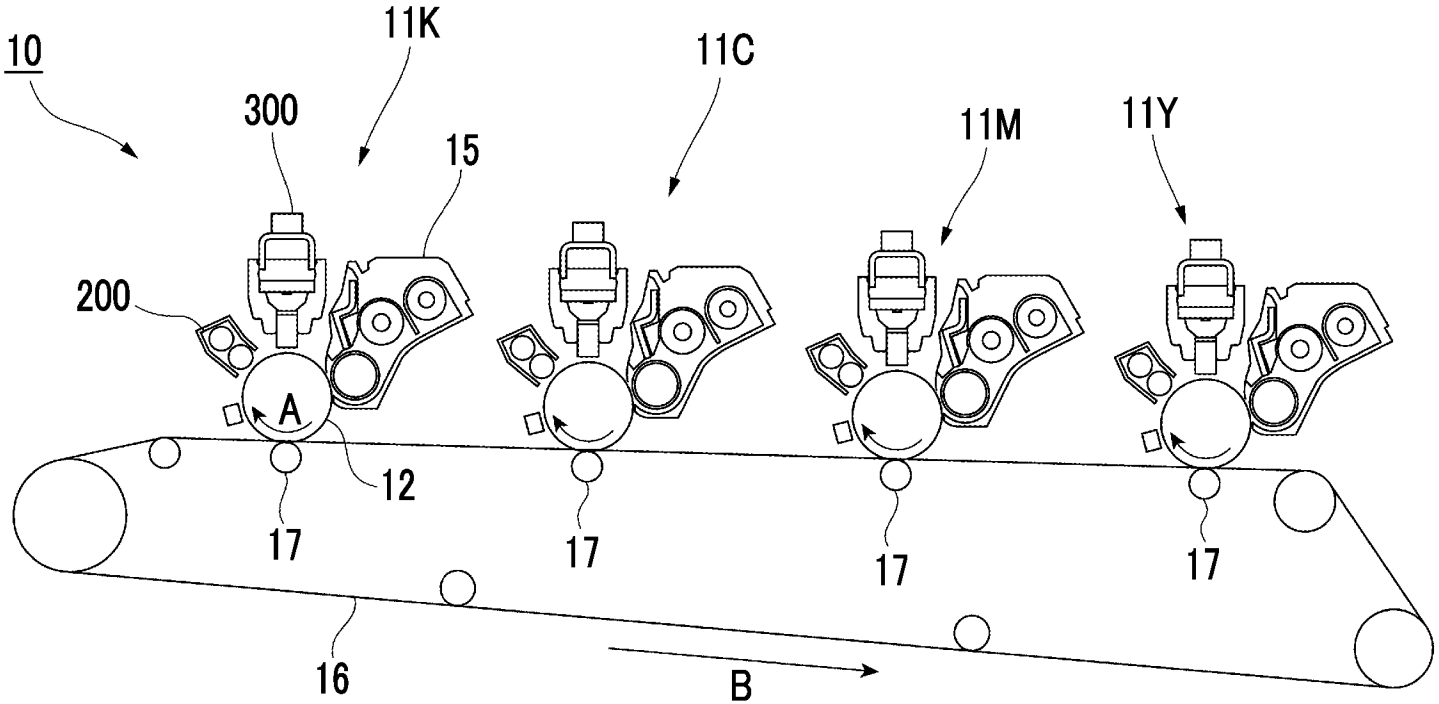
FIG. 2 is a diagram illustrating an image forming unit.

FIG. 2 is a diagram illustrating the image forming unit 10.

The image forming unit 10 is provided with four image forming portions 11Y, 11M, 11C, and 11K (hereinafter, also referred to as "image forming portions 11" simply and collectively) disposed in parallel at regular intervals.

The image forming portions 11 have the same configuration except for the toner that is stored in a developer 15 (described later). The image forming portions 11 respectively form yellow (Y), magenta (M), cyan (C), and black (K) toner images (images).

Each of the image forming portions 11 is provided with a photosensitive drum 12, a charger 200 performing charging of the photosensitive drum 12, and an LED print head (LPH) 300 performing exposure to the photosensitive drum 12.

The photosensitive drum 12 is charged by the charger 200. Further, the photosensitive drum 12 is exposed by the LPH 300 and an electrostatic latent image is formed on the photosensitive drum 12.

Further, each image forming portion 11 is provided with a cleaner (not illustrated) cleaning the surface of the photosensitive drum 12 and the developer 15 developing the electrostatic latent image formed on the photosensitive drum 12.

Further, the image forming unit 10 is provided with an intermediate transfer belt 16 onto which the toner image of each color formed on the photosensitive drum 12 is transferred and a primary transfer roll 17 sequentially transferring the toner image of each color formed on the photosensitive drum 12 to the intermediate transfer belt 16 (primary transfer).

In addition, in the present exemplary embodiment, a secondary transfer roll 19 collectively transferring the toner image transferred onto the intermediate transfer belt 16 to the sheet P (secondary transfer) is provided at the facing position of the image forming unit 10 as illustrated in FIG. 1.

In the present exemplary embodiment, the location where the intermediate transfer belt 16 and the secondary transfer roll 19 are disposed to face each other is a secondary transfer portion T. In the present exemplary embodiment, the toner image formed on the intermediate transfer belt 16 is transferred to the sheet P in this secondary transfer portion T.

In addition, as illustrated in FIG. 1, in the present exemplary embodiment, a fixing device 40 fixing the toner image secondarily transferred onto the sheet P to the sheet P is provided on the downstream side of the secondary transfer portion T in the transport direction of the sheet P.

The fixing device 40 is provided with a fixing roll 41 in which a heating source (not illustrated) is installed. In addition, the fixing device 40 is provided with a pressurizing roll 43 pressed against the fixing roll 41 and pressurizing the sheet P together with the fixing roll 41.

The pressurizing roll 43 is pressed against the outer peripheral surface of the fixing roll 41 and pressurizes the sheet P moving between the fixing roll 41 and the pressurizing roll 43. In other words, the pressurizing roll 43 pressurizes the sheet P moving through a sheet transport path R passing between the fixing roll 41 and the pressurizing roll 43.

A discharge roll 500 is provided on the downstream side of the fixing device 40 in the transport direction of the sheet P. The discharge roll 500 transports (delivers) the sheet P transported through the fixing device 40 toward a sheet loading portion 1E.

Further, in the present exemplary embodiment, an accommodation container 400 accommodating the sheet P supplied to the secondary transfer portion T is provided on the upstream side of the secondary transfer portion T in the transport direction of the sheet P.

This accommodation container 400 is housed in the housing 20 through the opening 21 provided in the side portion 20A of the housing 20.

In addition, in the present exemplary embodiment, a sheet support portion 80 supporting the sheet P set by so-called manual feeding from below is provided on the upstream side of the secondary transfer portion T in the transport direction of the sheet P.

Further, a delivery roll 81 delivering the sheet P supported by the sheet support portion 80 is provided.

Further, a transport unit 600 transporting the sheet P delivered by the delivery roll 81 to the secondary transfer portion T is provided.

This transport unit 600 as an example of a transport section is provided with two drive rolls 605 performing rotational driving and two rotating rolls 610 disposed in contact with this drive roll 605 and rotating by receiving a driving force from this drive roll 605.

This rotating roll 610 is supported by a support member 630 (described later).

Further, the transport unit 600 is provided with a registration roll 601 delivering a recording material toward the secondary transfer portion T.

The registration roll 601 is stopped in a case where the sheet P is transported to this registration roll 601. Then, rotation is initiated at a predetermined timing and the sheet P is delivered toward the secondary transfer portion T.

In addition, in the present exemplary embodiment, a delivery roll (not illustrated) delivering the sheet P accommodated in the accommodation container 400 toward the registration roll 601 is provided.

Further, in the present exemplary embodiment, the support member 630 supporting the sheet P from below with the transport by the transport unit 600 stopped is provided.

In the present exemplary embodiment, this sheet P is supported from below by the support member 630 in a case where the transport of the sheet P by the transport unit 600 is stopped.

In addition, in the present exemplary embodiment, the transport of the sheet P by the transport unit 600 is stopped in the event of jamming of the sheet P or the like. Then, in a case where the sheet P is stopped at the facing position of the support member 630 at this time, this sheet P is supported from below by the support member 630.

Here, the support member 630 also has a function as a guide member and the support member 630 guides the sheet P while supporting the sheet P from below in a case where the transport unit 600 transports the sheet P.

A series of processing in the image forming apparatus 1 will be described.

In the image forming apparatus 1, a signal based on image data is supplied to each image forming portion 11 (see FIG. 2).

Then, in the black (K) image forming portion 11K, for example, the photosensitive drum 12 is charged by the charger 200 while rotating in the direction of an arrow A and is exposed by the LPH 300 emitting light based on image data transmitted from an image processing unit (not illustrated).

As a result, an electrostatic latent image related to a black (K) image is formed on the photosensitive drum 12. Then, the electrostatic latent image formed on the photosensitive drum 12 is developed by the developer 15 and a black (K) toner image is formed on the photosensitive drum 12.

Likewise, yellow (Y), magenta (M), and cyan (C) toner images are formed in the image forming portions 11Y, 11M, and 11C, respectively.

The toner images of the respective colors formed by the image forming portions 11 are sequentially and electrostatically suctioned by the primary transfer roll 17 onto the intermediate transfer belt 16 moving in the direction of an arrow B and a toner image in which the toners of the respective colors are superimposed is formed on the intermediate transfer belt 16.

The toner image formed on the intermediate transfer belt 16 moves to the secondary transfer portion T (see FIG. 1) as the intermediate transfer belt 16 moves.

Then, the sheet P is delivered from the sheet support portion 80 or the accommodation container 400 at the timing when the toner image reaches the secondary transfer portion T and this sheet P is supplied to the secondary transfer portion T.

In the secondary transfer portion T, the toner image on the intermediate transfer belt 16 is collectively and electrostatically transferred to the transported sheet P by the transfer electric field that is formed by the secondary transfer roll 19.

Subsequently, with the toner image electrostatically transferred, the sheet P is separated from the intermediate transfer belt 16 and transported to the fixing device 40.

In the fixing device 40, the rotating fixing roll 41 and the pressurizing roll 43 sandwich the sheet P. As a result, the sheet P is pressurized and heated while being transported and the toner image on the sheet P is fixed to the sheet P.

Then, with the fixing ended, the sheet P is transported to the sheet loading portion 1E by the discharge roll 500.

Here, in the present exemplary embodiment, the location where the transport unit 600 is provided has a transport function for the sheet P, which is an example of a recording material, and the location where the transport unit 600 is provided in the image forming apparatus 1 can also be regarded as a recording material transport device.

As illustrated in FIG. 1, the support member 630 is disposed to extend in a direction intersecting with the vertical direction and has one end portion 630A positioned on the opening 21 side and the other end portion 630B positioned on a side away from the opening 21.

In addition, the support member 630 has the one end portion 630A and the other end portion 630B having different positions in the direction intersecting with the vertical direction.

Here, the support member 630 is provided to be capable of descending. As described later, the support member 630 moves downward by being operated by an operator.

In the present exemplary embodiment, both the one end portion 630A and the other end portion 630B descend as the support member 630 moves downward. Further, in the present exemplary embodiment, the support member 630 is inclined by the one end portion 630A being positioned below the other end portion 630B (described later).

Further, in the present exemplary embodiment, a plate-shaped guide member 640 guiding the support member 630 is provided on both the rear side and the front side of the image forming apparatus 1.

It should be noted that the guide member 640 indicated by reference numeral 1A in FIG. 1 indicates the guide member 640 positioned on the front side of the image forming apparatus 1. The guide member 640 on the rear side is positioned behind the guide member 640 on the front side.

Figure 3:
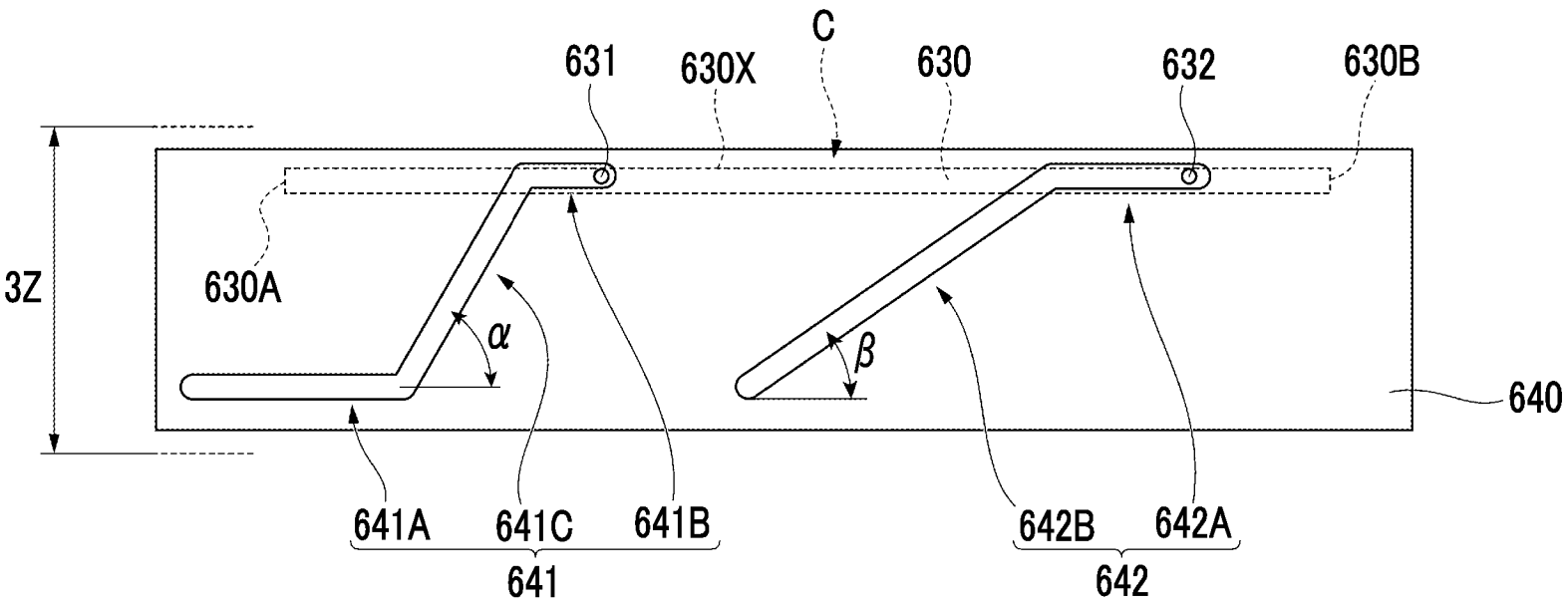

FIG. 3 is an enlarged view of the guide member 640 and so on illustrated in FIG. 1.

It should be noted that the rotating roll 610 (see FIG. 1) provided on the support member 630 is not illustrated in FIG. 3. In addition, the accommodation container 400 is not illustrated in FIG. 3.

In the present exemplary embodiment, a first projection 631 and a second projection 632 are provided to cooperate with the support member 630.

The first projection 631 and the second projection 632 are guided by the guide member 640. In addition, the first projection 631 and the second projection 632 are provided on both the rear side and the front side of the image forming apparatus 1.

The first projection 631 as an example of a first guided portion is provided on the one end portion 630A side of the support member 630 and provided to cooperate with the support member 630.

Here, the one end portion 630A side of the support member 630 refers to being positioned closer to the one end portion 630A side of the support member 630 than a longitudinal middle portion C of the support member 630.

The first projection 631 is guided by the main body side of the image forming apparatus 1 in a case where the support member 630 descends. More specifically, the first projection 631 is guided by the guide member 640.

In addition, the second projection 632 as an example of a second guided portion is provided on the other end portion 630B side of the support member 630 and provided to cooperate with the support member 630.

Here, the other end portion 630B side of the support member 630 refers to being positioned closer to the other end portion 630B side of the support member 630 than the longitudinal middle portion C of the support member 630.

The second projection 632 is also guided by the main body side of the image forming apparatus 1 in a case where the support member 630 descends. More specifically, the second projection 632 is guided by the guide member 640.

A first guide groove 641 and a second guide groove 642 are formed in the two guide members 640, respectively.

In the present exemplary embodiment, the one end portion 630A side of the support member 630 is guided by the first guide groove 641. In addition, the other end portion 630B side of the support member 630 is guided by the second guide groove 642.

More specifically, in the present exemplary embodiment, the first projection 631 is guided by the first guide groove 641 and the second projection 632 is guided by the second guide groove 642.

The first guide groove 641 is provided with a lower side horizontal portion 641A positioned at the lowest position and extending in the horizontal direction and an upper side horizontal portion 641B positioned at the uppermost position and extending in the horizontal direction.

In addition, the first guide groove 641 is provided with a connection portion 641C disposed to be inclined with respect to the vertical direction and connecting the lower side horizontal portion 641A and the upper side horizontal portion 641B.

In addition, the second guide groove 642 is provided with an upper side horizontal portion 642A positioned at the uppermost position and extending in the horizontal direction.

In addition, the second guide groove 642 is provided with an inclined portion 642B disposed to be inclined with respect to the vertical direction and extending diagonally downward from a location connected to the upper side horizontal portion 642A.

Parts (A) to (D) in FIG. 4 and parts (A) and (B) in FIG. 5 are diagrams illustrating movements of the first projection 631 and the second projection 632.

In the present exemplary embodiment, the operator lowers the support member 630 in a case where, for example, the transport of the sheet P by the transport unit 600 is stopped and the sheet P is stopped at the facing position of the support member 630.

In addition, in the event of jamming of the sheet P in the present exemplary embodiment, the transport path of the sheet P is opened by the support member 630 being lowered and the sheet P stopped at the facing position of the support member 630 is removed.

More specifically, in the event of jamming of the sheet P in the present exemplary embodiment, the accommodation container 400 (see FIG. 1) is pulled out from the housing 20 first. Subsequently, the support member 630 is lowered and the stopped sheet P is removed.

In a case where the support member 630 (see FIG. 1) is lowered in the present exemplary embodiment, the support member 630 is moved to the opening 21 side first.

In the present exemplary embodiment, the support member 630 is capable of moving in the direction intersecting with the vertical direction and to the side where the opening 21 is provided from the one end portion 630A side.

More specifically, in a case where the support member 630 is lowered, the support member 630 is moved to the opening 21 side after, for example, the one end portion 630A of the support member 630 or a lever (not illustrated) connected to the support member 630 is gripped first.

With the support member 630 moved to the opening 21 side, each of the first projection 631 and the second projection 632 moves to the location that is indicated by reference numeral 4F as illustrated in parts (A) and (B) in FIG. 4.

Here, a state where the support member 630 is yet to be moved is illustrated in the part (A) in FIG. 4.

With the support member 630 moved to the opening 21 side, each of the first projection 631 and the second projection 632 moves to the location that is indicated by reference numeral 4F as illustrated in the part (B) in FIG. 4.

In addition, with the support member 630 moved to the opening 21 side, each of the rotating rolls 610 (see FIG. 1) supported by the support member 630 also moves to the opening 21 side.

In a case where the sheet P is sandwiched between the drive roll 605 and the rotating roll 610 and the sheet P is nipped in this case, the rotating roll 610 is separated from the drive roll 605 and this nip is released.

The support member 630 (not illustrated in the part (B) in FIG. 4) further moves to the opening 21 side from the state illustrated in the part (B) in FIG. 4, and then the first projection 631 reaches the connection portion 641C as illustrated in the part (C) in FIG. 4.

Then, the first projection 631 starts to descend. In a case where the first projection 631 reaches the connection portion 641C in the present exemplary embodiment, the second projection 632 is positioned in the connection portion between the upper side horizontal portion 642A and the inclined portion 642B as illustrated in the part (C) in FIG. 4.

In the present exemplary embodiment, the first projection 631 starts to descend first. Further, in this case, in the present exemplary embodiment, the one end portion 630A (see FIG. 1) of the support member 630 starts to descend earlier than the other end portion 630B.

More specifically, in the present exemplary embodiment, the part that is indicated by reference numeral 4H in the part (B) in FIG. 4 is a support portion supporting the support member 630 (not illustrated in the part (B) in FIG. 4) from below.

Here, the support of the support member 630 is not limited to an aspect in which the support member 630 is directly supported and the support of the support member 630 also includes an aspect in which a part cooperating with the support member 630 is supported.

In the present exemplary embodiment, the support of the support member 630 by the support portion indicated by reference numeral 4H is released in a case where the support member 630 is moved in the direction intersecting with the vertical direction and to the side where the opening 21 is provided. As a result, the support member 630 can be lowered.

In addition, in a case where the support member 630 is moved in the direction intersecting with the vertical direction and to the side where the opening 21 is provided, the support of the first projection 631 by the support portion indicated by reference numeral 4H is released and the support member 630 can be lowered.

It should be noted that the part that is indicated by reference numeral 4J in the part (B) in FIG. 4 is a support portion on the second projection 632 side and the second projection 632 descends in a case where the second projection 632 exits from above this support portion.

Subsequently, each of the first projection 631 and the second projection 632 moves as illustrated in the part (D) in FIG. 4 to the part (B) in FIG. 5.

Here, in the present exemplary embodiment, the first projection 631 is positioned below the second projection 632 while the first projection 631 and the second projection 632 move downward.

Accordingly, in the present exemplary embodiment, the support member 630 (see FIG. 1) descends while maintaining a state of being inclined with respect to the horizontal direction.

In addition, in the present exemplary embodiment, each of the first projection 631 and the second projection 632 moves to the opening 21 (see FIG. 1) side while descending as illustrated in the parts (C) and (D) in FIG. 4 and the part (A) in FIG. 5.

As a result, in the present exemplary embodiment, the support member 630 (see FIG. 1) also moves to the opening 21 side while descending.

In addition, the support member 630 moves to the side where the opening 21 is provided while maintaining an inclined state. In other words, the support member 630 moves in the direction intersecting with the vertical direction in an inclined state.

In a case where the support member 630 is inclined in this manner, the sheet P placed on the support member 630 is more easily visually recognized than in a case where the support member 630 is not inclined.

More specifically, the sheet P placed on the support member 630 is easily visually recognized in a case where the support member 630 is viewed from the outside of the housing 20 through the opening 21 (see FIG. 1).

In addition, in the present exemplary embodiment, the support member 630 descends with the sheet P placed on the support member 630 in a case where the support member 630 is lowered with the sheet P stopped at the facing position of the support member 630.

In a case where the support member 630 is inclined in this case, the sheet P placed on the support member 630 is visually recognized with ease.

More specifically, in a case where the support member 630 is inclined in the present exemplary embodiment, a sheet support surface 630X (see FIG. 3) of the support member 630 that supports the sheet P is directed to the opening 21 (see FIG. 1) side. In addition, in a case where the support member 630 is inclined in the present exemplary embodiment, the upper surface of the support member 630 is directed to the opening 21 side.

In a case where the sheet P placed on the support member 630 is viewed from the opening 21 side, the sheet P is more easily visually recognized in this case than in a case where the sheet support surface 630X is not directed to the opening 21 side.

Further, in a case where the support member 630 is inclined as in the present exemplary embodiment, the sheet P placed on the support member 630 may move to the opening 21 side while sliding on the support member 630.

In this case, it is easier to remove the sheet P placed on the support member 630 than in a case where the sheet P does not move to the opening 21 side.

It should be noted that the support member 630 in the present exemplary embodiment is disposed along the horizontal direction as illustrated in FIG. 3 before the support member 630 starts to descend.

However, the present invention is not limited thereto and the support member 630 may be disposed in a state of being inclined with respect to the horizontal direction before the support member 630 starts to descend.

More specifically, for example, the support member 630 may be inclined, such that the one end portion 630A is positioned below the other end portion 630B or the other end portion 630B is positioned below the one end portion 630A, before the support member 630 starts to descend.

In a case where the one end portion 630A and the other end portion 630B of the support member 630 start to descend as described above in this case, the inclination of the support member 630 becomes larger than the pre-descending inclination.

Here, in the present exemplary embodiment, "the support member 630 is inclined such that the one end portion 630A is positioned below the other end portion 630B as the support member 630 descends" is not limited to an aspect in which the support member 630 along the horizontal direction is inclined as the support member 630 descends.

"The support member 630 is inclined such that the one end portion 630A is positioned below the other end portion 630B as the support member 630 descends" also includes an aspect in which the support member 630 inclined from the beginning is further inclined as the support member 630 descends.

Movements of the first projection 631, the second projection 632, and so on will be further described with reference to the part (D) in FIG. 4 and the parts (A) and (B) in FIG. 5.

After the state of the part (D) in FIG. 4 in the present exemplary embodiment, the first projection 631 reaches the lower side horizontal portion 641A as illustrated in the part (A) in FIG. 5. At this time in the present exemplary embodiment, the second projection 632 is positioned above the first projection 631.

In this case, in the present exemplary embodiment, the one end portion 630A (see FIG. 3) positioned on the opening 21 side reaches the lowermost end portion earlier than the other end portion 630B positioned on the side away from the opening 21.

In addition, although the region that is indicated by reference numeral 3Z in FIG. 3 is the movable region of the support member 630 in the present exemplary embodiment, the one end portion 630A positioned on the opening 21 side reaches the lowermost end portion of the movable region earlier than the other end portion 630B positioned on the side away from the opening 21 in the present exemplary embodiment.

Subsequently, in the present exemplary embodiment, the operator further moves the support member 630 to the near side.

As a result, the first projection 631 and the second projection 632 are put into the state illustrated in the part (B) in FIG. 5.

More specifically, the first projection 631 is positioned in the left end portion of the lower side horizontal portion 641A and the second projection 632 is positioned in the lower end portion of the inclined portion 642B.

Further, at this time, the support member 630 is along the horizontal direction. In addition, in the present exemplary embodiment, the support member 630 is along the horizontal direction in a case where the support member 630 is lowered most.

Here, in a case where the support member 630 is lowered in the present exemplary embodiment, the inclination angle of the support member 630 with respect to the horizontal direction gradually decreases after the inclination angle of the support member 630 with respect to the horizontal direction gradually increases.

Then, finally, the support member 630 is along the horizontal direction as described above.

More specifically, in the present exemplary embodiment, the inclination angle of the support member 630 with respect to the horizontal direction gradually increases between the state of the first projection 631 and the second projection 632 illustrated in the part (B) in FIG. 4 and the state of the first projection 631 and the second projection 632 illustrated in the part (A) in FIG. 5.

In addition, in the present exemplary embodiment, the inclination angle of the support member 630 with respect to the horizontal direction gradually decreases between the state of the first projection 631 and the second projection 632 illustrated in the part (A) in FIG. 5 and the state of the first projection 631 and the second projection 632 illustrated in the part (B) in FIG. 5.

Then, finally, the support member 630 is along the horizontal direction. In addition, the support member 630 is along the horizontal direction when the first projection 631 and the second projection 632 are in the state illustrated in the part (B) in FIG. 5.

It should be noted that the one end portion 630A of the support member 630 (see FIG. 1) exits from the housing 20 through the opening 21 in a case where the first projection 631 and the second projection 632 in the present exemplary embodiment are in the state illustrated in the part (B) in FIG. 5.

The movement of each portion subsequent to the completion of the removal of the sheet P will be described.

In a case where the removal of the sheet P is completed in the present exemplary embodiment, the operator returns the accommodation container 400 to the original location. More specifically, in a case where the removal of the sheet P is completed, the operator puts the accommodation container 400 into the housing 20 through the opening 21.

As a result, in the present exemplary embodiment, the support member 630 that is lowered moves upward by receiving a force from the accommodation container 400.

After the accommodation container 400 is put into the housing 20 through the opening 21, the one end portion 630A of the support member 630 (see FIG. 1) is pressed by the accommodation container 400 and moves toward the inside of the housing 20.

More specifically, reference numeral 1Z in FIG. 1 indicates the one end portion 630A of the support member 630 that is outside the housing 20.

In the present exemplary embodiment, the one end portion 630A is pressed by the accommodation container 400 and the support member 630 moves toward the inside of the housing 20.

Further, in this case, the support member 630 moves upward by performing a movement opposite to the movement at the time of the descending described above.

In a case where the support member 630 moves upward, the first projection 631 and the second projection 632 are disposed in the state illustrated in the part (B) in FIG. 4.

Subsequently, in the present exemplary embodiment, a user operates a lever (not illustrated) or the like. Then, the support member 630 is further pushed (the support member 630 is further moved rightward in FIG. 1). As a result, the support member 630 is put into the initial state. In other words, the support member 630 is put into a state where descending is yet to be initiated.

Parts (A) to (D) in FIG. 6 and parts (A) to (D) in FIG. 7 are diagrams illustrating another configuration example of the guide member 640.

In this configuration example, the first projection 631 moves along the vertical direction in a case where the first projection 631 descends.

In addition, in this configuration example, the connection portion 641C connecting the upper side horizontal portion 641B and the lower side horizontal portion 641A extends along the vertical direction as illustrated in the part (A) in FIG. 6. In a case where the first projection 631 descends, the first projection 631 moves downward in the vertical direction.

Further, in this configuration example, the support member 630 (see FIG. 1) can be moved to the side where the opening (see FIG. 1) is provided after the first projection 631 reaches the lowermost end portion as illustrated in the parts (A) and (B) in FIG. 7.

More specifically, in this configuration example, the support member 630 can be moved to the side where the opening 21 is provided after the first projection 631 reaches the connection location between the lower side horizontal portion 641A and the connection portion 641C (see the part (A) in FIG. 7).

In addition, in this configuration example, the connection portion 641C is along the vertical direction, and the support member 630 does not move to the opening 21 side while the first projection 631 moves on the connection portion 641C.

The support member 630 can be moved to the side where the opening 21 is provided by the first projection 631 reaching the connection location between the connection portion 641C and the lower side horizontal portion 641A.

More specifically, in this configuration example, the first projection 631 can be moved to the lower side horizontal portion 641A after the first projection 631 reaches the lowermost end portion of the connection portion 641C.

Further, in this case, the support member 630 can be moved to the side where the opening 21 is provided after the first projection 631 reaches the lowermost end portion.

In this configuration example, the first projection 631 moves along the vertical direction. Accordingly, the inclination angle of the support member 630 in a case where the first projection 631 reaches the lowermost end portion is larger than in a case where the first projection 631 moves diagonally downward as described above.

Further, in this case, the sheet P on the support member 630 is visually recognized with ease. In addition, in a case where the inclination angle of the support member 630 is large, the sheet P is visually recognized with ease in a case where the sheet P on the support member 630 is viewed through the opening 21.

Here, in the configuration example illustrated in FIGS. 6 and 7, the first projection 631 reaches the lowermost end portion of the connection portion 641C (see the part (A) in FIG. 7), and then the support member 630 is inclined with respect to the horizontal direction in a case where the support member 630 (see FIG. 1) moves to the side where the opening 21 is provided. In addition, in this configuration example, the support member 630 is inclined with respect to the horizontal direction in a case where the first projection 631 moves along the lower side horizontal portion 641A as illustrated in the parts (A) to (D) in FIG. 7.

More specifically, in this configuration example, the first projection 631 moves along the connection portion 641C (see the part (C) in FIG. 6), which is a linear movement path, in descending.

In addition, the second projection 632 also moves along the inclined portion 642B (see the part (C) in FIG. 6), which is a linear movement path, in descending.

Further, in this configuration example, an inclination angle $\alpha$ of the connection portion 641C with respect to the horizontal direction is larger than an inclination angle $\beta$ of the inclined portion 642B with respect to the horizontal direction as illustrated in the part (C) in FIG. 6.

Here, in the present exemplary embodiment, the "inclination angle with respect to the horizontal direction" is an inclination angle of 90° in a case where the inclination angle is 90°.

In addition, in a case where the two angles of an acute angle-side angle and an obtuse angle-side angle are obtained, the acute angle-side angle is the "inclination angle with respect to the horizontal direction".

It should be noted that the same applies to the configuration example illustrated in FIG. 3 although not described above. Also in the configuration example illustrated in FIG. 3, the inclination angle $\alpha$ of the connection portion 641C with respect to the horizontal direction is larger than the inclination angle $\beta$ of the inclined portion 642B with respect to the horizontal direction.

Other

In a case where positions in the direction intersecting with the vertical direction are compared in the above, the position of the one end portion 630A of the support member 630 and the position of the first projection 631 are misaligned and the position of the other end portion 630B of the support member 630 and the position of the second projection 632 are misaligned.

Here, these positional relationships are merely one example. In another example, the first projection 631 may be provided in one end portion 630A of the support member 630 and the second projection 632 may be provided in the other end portion 630B of the support member 630.

In addition, although the support member 630 is configured to move to the opening 21 side in the above, the movement of the support member 630 to the opening 21 side is optional and the support member 630 may not move to the opening 21 side in another configuration.

In addition, a configuration in which the support member 630 starts to descend by the support member 630 moving to the opening 21 side has been described above as an example.

However, the present invention is not limited thereto. For example, a fixing mechanism may be provided at the location indicated by reference numeral 8A in FIG. 8 (diagram illustrating another configuration example of the guide member 640 and so on) and the support member 630 (not illustrated in FIG. 8) may start to descend by fixing by this fixing mechanism being released.

The fixing mechanism is configured by, for example, a rotating member 699 disposed coaxially with the first projection 631 and a lever member 700 rotating the rotating member 699.

The rotating member 699 is provided with a projection 699A hooked on the main body side of the image forming apparatus 1. In a case where the support member 630 is positioned above, this projection 699A is hooked on the main body side of the image forming apparatus 1.

In a case where an operator rotates the rotating member 699 by using the lever member 700, the hooking of the projection 699A on the main body side is released and the support member 630 descends.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A recording material transport device comprising:

a transport section that transports a recording material, wherein the transport section comprises a drive roll and a rotating roll, wherein the rotating roll is disposed in contact with the drive roll;

a support member disposed to extend in a direction intersecting with a vertical direction, and supporting the recording material from below with the transport section stopped;

a guide member disposed to extend in the direction intersecting with the vertical direction and to guide the support member;

a first projection provided on one end portion side of the support member to cooperate with the support member and guided by a main body side of the recording material transport device in a case where the support member descends; and a second projection provided on another end portion side of the support member to cooperate with the support member and guided by the main body side in a case where the support member descends, wherein the support member is provided to be capable of descending, and, as the support member descends, both of the one end portion side and the another end portion side in the direction intersecting with the vertical direction descend and are inclined such that the one end portion side is positioned below the another end portion side, the guide member comprises a first guide groove and a second guide groove, wherein the one end portion side of the support member is guided by the first guide groove, and the another end portion side of the support member is guided by the second guide groove, the first projection moves along a first linear movement path in descending, the second projection moves along a second linear movement path in descending, and an inclination angle of the first linear movement path along which the first projection moves with respect to a horizontal direction is larger than an inclination angle of the second linear movement path along which the second projection moves with respect to the horizontal direction.

2. The recording material transport device according to claim 1, further comprising a housing having a side portion provided with an opening and accommodating the transport section and the support member, wherein the support member is provided to be movable in the direction intersecting with the vertical direction and to a side where the opening is provided, with the one end portion side as a leading end.

3. The recording material transport device according to claim 2, wherein the support member is provided to be movable in the direction intersecting with the vertical direction and to the side where the opening is provided in the inclined state.

4. The recording material transport device according to claim 2, wherein the one end portion side of the support member exits from the housing through the opening in a case where the support member is moved in the direction intersecting with the vertical direction and to the side where the opening is provided.

5. The recording material transport device according to claim 1, wherein the one end portion side starts to descend earlier than the another end portion side in a case where the support member is lowered.

6. The recording material transport device according to claim 1, wherein an inclination angle of the support member with respect to a horizontal direction gradually decreases after the inclination angle of the support member with respect to the horizontal direction gradually increases in a case where the support member is lowered.

7. The recording material transport device according to claim 1, wherein the support member is along a horizontal direction in a case where the support member is lowered most.

8. The recording material transport device according to claim 1, wherein at least one of the first guide groove and the second guide groove comprises an upper side horizontal portion positioned at the uppermost position and extending in the horizontal direction, a sidewall of the upper side horizontal portion is in contact with the support member and supports the support member from below, wherein the support of the support member by the upper side horizontal portion is released and the support member is capable of descending by moving the support member in the direction intersecting with the vertical direction.

9. The recording material transport device according to claim 8, further comprising a housing having a side portion provided with an opening and accommodating the transport section and the support member, wherein the support of the support member by the upper side horizontal portion is released by moving the support member in the direction intersecting with the vertical direction and to a side where the opening is provided.

10. The recording material transport device according to claim 1, further comprising a housing having a side portion provided with an opening and accommodating the transport section and the support member, wherein the support member in a lowered state moves upward by receiving a force from an accommodation container accommodating the recording material in a case where the accommodation container is put into the housing through the opening.

11. An image forming apparatus comprising:

an image forming section that forms an image on a recording material; and a recording material transport device transporting the recording material, wherein the recording material transport device is configured to include the recording material transport device according to claim 1.

12. A recording material transport device comprising:

a housing having a side portion provided with an opening;

a transport section that transports a recording material, the transport section being provided in the housing, wherein the transport section comprises a drive roll and a rotating roll, wherein the rotating roll is disposed in contact with the drive roll;

a support member disposed to extend in a direction intersecting with a vertical direction, and supporting the recording material from below with the transport section stopped;

a guide member disposed to extend in the direction intersecting with the vertical direction and to guide the support member;

a first projection provided on one end portion side of the support member to cooperate with the support member and guided by a main body side of the recording material transport device in a case where the support member descends; and a second projection provided on another end portion side of the support member to cooperate with the support member and guided by the main body side in a case where the support member descends, wherein the support member is provided to be capable of descending, and, as the support member descends, each of the one end portion side and the another end portion side in the direction intersecting with the vertical direction descends and the one end portion side positioned on the opening side starts to descend earlier than the another end portion side positioned on a side away from the opening, the guide member comprises a first guide groove and a second guide groove, wherein the one end portion side of the support member is guided by the first guide groove, and the another end portion side of the support member is guided by the second guide groove, the first projection moves along a first linear movement path in descending, the second projection moves along a second linear movement path in descending, and an inclination angle of the first linear movement path along which the first projection moves with respect to a horizontal direction is larger than an inclination angle of the second linear movement path along which the second projection moves with respect to the horizontal direction.

13. The recording material transport device according to claim 12, wherein the support member is movable in the direction intersecting with the vertical direction and to a side where the opening is provided, with the one end portion side as a leading end.

14. The recording material transport device according to claim 12, wherein the first projection moves along the vertical direction in a case where the first projection descends.

15. A recording material transport device comprising:

a housing having a side portion provided with an opening;

a transport section that transports a recording material, the transport section being provided in the housing, wherein the transport section comprises a drive roll and a rotating roll, wherein the rotating roll is disposed in contact with the drive roll;

a support member disposed to extend in a direction intersecting with a vertical direction, and supporting the recording material from below with the transport section stopped;

a guide member disposed to extend in the direction intersecting with the vertical direction and to guide the support member;

a first projection provided on one end portion side of the support member to cooperate with the support member and guided by a main body side of the recording material transport device in a case where the support member descends; and a second projection provided on another end portion side of the support member to cooperate with the support member and guided by the main body side in a case where the support member descends, wherein the support member is provided to be capable of descending, and, as the support member descends, each of the one end portion side and the another end portion side in the direction intersecting with the vertical direction descends and the one end portion side positioned on the opening side reaches a lowermost end portion earlier than the another end portion side positioned on a side away from the opening, the guide member comprises a first guide groove and a second guide groove, wherein the one end portion side of the support member is guided by the first guide groove, and the another end portion side of the support member is guided by the second guide groove, the first projection moves along a first linear movement path in descending, the second projection moves along a second linear movement path in descending, and an inclination angle of the first linear movement path along which the first projection moves with respect to a horizontal direction is larger than an inclination angle of the second linear movement path along which the second projection moves with respect to the horizontal direction.

16. The recording material transport device according to claim 15, further comprising:

wherein the support member is movable in the direction intersecting with the vertical direction and to a side where the opening is provided after the first projection reaches the lowermost end portion, and the support member is inclined with respect to a horizontal direction in a case where the first projection reaches the lowermost end portion and the support member is moved in the direction intersecting with the vertical direction and to the side where the opening is provided.

* * * * *